United States Patent [19]

Kern et al.

[11] 4,297,400

[45] Oct. 27, 1981

[54] PROCESS FOR IMPARTING TO TEXTILE MATERIALS A SOFT HANDLE USING UNSATURATED ALIPHATIC ACID AMIDES

[75] Inventors: Jörg Kern, Waldkraiburg, Fed. Rep. of Germany; Christian Guth, Basel, Switzerland

[73] Assignee: Ciba-Geigy Corporation, Ardsley, N.Y.

[21] Appl. No.: 64,659

[22] Filed: Aug. 8, 1979

[30] Foreign Application Priority Data

Aug. 18, 1978 [CH] Switzerland ..... 8788/78

[51] Int. Cl.[3] ..... B05D 3/02

[52] U.S. Cl. ..... 427/389; 8/495; 8/639; 252/8.8; 427/389.9; 437/392; 428/260; 428/270; 428/272

[58] Field of Search ..... 427/390 A, 390 B, 390 C, 427/390 D, 390 E, 389, 389.9, 392; 8/115.5, 128, 194, 495, 639; 260/17.4 G, 17.4 C, 8, 29.6 RW; 525/296, 426, 374, 445; 428/260, 270, 272, 274; 252/8.8

[56] References Cited

U.S. PATENT DOCUMENTS

| | | | |
|---|---|---|---|
| 2,718,478 | 9/1955 | Fluck et al. | 427/390 B X |
| 3,161,679 | 12/1964 | D'Errico et al. | 260/561 N |
| 3,822,145 | 7/1974 | Liebowitz et al. | 427/390 B X |
| 3,992,304 | 11/1976 | Minegishi et al. | 8/115.5 X |
| 4,182,790 | 1/1980 | Schmidle | 428/260 |

FOREIGN PATENT DOCUMENTS

| | | |
|---|---|---|
| 2181047 | 11/1973 | France . |
| 1424698 | 2/1976 | United Kingdom . |

*Primary Examiner*—Ronald H. Smith
*Assistant Examiner*—Thurman K. Page
*Attorney, Agent, or Firm*—John P. Spitals; Edward McC. Roberts

[57] ABSTRACT

A process for imparting to textile materials a soft handle finish is disclosed, wherein an acid amide of the formula $$CH_2{=}C(X){-}CO{-}NH{-}R_1$$

or a reaction product from acrylic or methacrylic acid, or the lower alkyl esters of these acids, and an amine of the formula $$R_1{-}NH_2$$

is used as a soft-handle agent. $R_1$ is alkyl or alkenyl having 14 to 22 carbon atoms, and X is hydrogen or methyl.

There is preferably produced from the acid amide and commercial emulsifiers and wetting agents, in a novel composition, a concentrated high-pressure emulsion, which is diluted to give an aqueous preparation that is applied to the textile materials.

12 Claims, No Drawings

PROCESS FOR IMPARTING TO TEXTILE MATERIALS A SOFT HANDLE USING UNSATURATED ALIPHATIC ACID AMIDES

The present invention relates to a process for imparting to textile materials a soft handle, in which process there is used an acid amide of the formula $$CH_2{=}C(X){-}CO{-}NH{-}R_1 \quad (1)$$

wherein $R_1$ is alkenyl or preferably alkyl having 14 to 22 carbon atoms, and X is hydrogen or methyl.

The acid amides of the formula (1) are known per se and are produced by known methods. Thus, for example, the U.S. Pat. No. 3,161,679 describes N-(octadecyl)-acrylic acid amide, its use as an intermediate for wetting agents and detergents, and its production according to U.S. Pat. No. 2,573,673 from octadec-1-ene and acrylonitrile in the presence of sulfuric acid using the so-called Ritter reaction.

It is possible to use according to the present invention, instead of pure acid amides of the formula (1), which are produced for example according to the U.S. Pat. No. 2,573,673, also reaction products from acrylic acid or methacrylic acid, or the lower alkyl esters of these acids, and the amine of the formula $$R_1{-}NH_2, \quad (2)$$

wherein $R_1$ has the given meanings. The lower alkyl groups of the acrylic or methacrylic esters, from which the reaction products are obtained, contain as a rule 1 to 4 carbon atoms. Commercial reaction products of this type usually contain 50 to 80 percent by weight of the acid amide of the formula (1) as principal product and 20 to 50 percent by weight of a mixture of the β-aminocarboxylic acid ester of the formula $$R_1{-}NH{-}CH_2{-}CH(X){-}COO{-}R_2 \quad (3)$$

and the β-aminocarboxylic acid amide of the formula $$R_1{-}NH{-}CH_2{-}CH(X){-}CO{-}NH{-}R_1 \quad (4),$$

or a mixture of the β-aminocarboxylic acid of the formula $$R_1{-}NH{-}CH_2{-}CH(X){-}COOH \quad (5)$$

and the β-aminocarboxylic acid amide of the formula (4), wherein $R_1$ is alkenyl or alkyl having 14 to 22 carbon atoms, $R_2$ is alkyl having 1 to 4 carbon atoms, and X is hydrogen or methyl. Preferably, $R_1$ is alkyl having 14 to 22 carbon atoms.

The subject matter of the invention is therefore a process for imparting to textile materials a soft handle, which process comprises applying to these materials an aqueous preparation containing at least one reaction product of the type defined or preferably an acid amide of the formula (1), and subsequently drying the material.

Further subject matter of the invention is the aqueous preparation for carrying out the process, which preparation contains, in addition to the acid amide of the formula (1) or to the reaction product, an emulsifier and optionally a wetting agent. A concentrated composition which is in the form of a concentrated emulsion or dispersion, and which contains, in addition to the acid amide of the formula (1) or to the reaction product, an emulsifier and optionally a wetting agent, and from which the aqueous preparation is obtained by dilution with water, likewise forms subject matter of the present invention. The same applies also to the textile material to which has been imparted a soft feel by the process according to the invention.

Preferred acid amides contained in the preparation used according to the invention correspond to the formula $$CH_2{=}C(X){-}CO{-}NH{-}R_3 \quad (6),$$

or particularly to the formula $$CH_2{=}C(X){-}CO{-}NH{-}(CH_2)_{17}{-}CH_3 \quad (7)$$

wherein $R_3$ is alkyl having 16 to 22 carbon atoms, and X has the meaning already defined.

The acid amide of particular interest is N-(octadecyl)-acrylic acid amide.

Also suitable however are commercial mixtures of the acid amides or of the reaction products, in which $R_1$ in the formulae (1) to (5) is various alkenyl and/or alkyl groups which have 14 to 22 carbon atoms and which are derived from mixtures of fatty acids, such as are present in vegetable or animal oils and fats, especially in tallow fat.

The aqueous diluted preparation with which the textile materials are treated according to the invention contains in general 0.1 to 0.5 percent by weight, relative to the dry textile material to be treated, of the acid amide of the formula (1) or of the reaction product.

As already indicated, the preparation according to the invention is in the form of an aqueous emulsion or dispersion. For this purpose, it contains, in addition to the acid amide of the formula (1) or to the reaction product, at least one commercial emulsifier, and as a rule at least one commercial wetting agent.

Examples of commercial emulsifiers which may be mentioned are inter alia: reaction products of a fatty acid with an alkanolamine or with a polyalkylenepolyamine, the fatty acid preferably having 8 to 18 carbon atoms, the alkanolamine preferably having 1 to 10 carbon atoms, and the polyalkylenepolyamine preferably having 2 to 5 nitrogen atoms and preferably 2 to 6 carbon atoms in the alkylene moiety. These reaction products concomitantly used as emulsifiers are optionally quaternised with a dialkyl sulfate having 1 to 4 carbon atoms in the alkyl group, or optionally further reacted with a nitrile of the acrylic acid series or with an alkylene oxide having 2 or 3 carbon atoms in the alkyl group. As examples of specific emulsifiers suitable for use in the preparation used according to the invention, there may be mentioned, inter alia, reaction products of stearic acid with diethanolamine, which optionally are quaternised with dimethyl sulfate or further reacted with acrylonitrile or with ethylene oxide.

As examples of commercial wetting agents, which preferably can be contained, in addition to the acid amide of the formula (1) and to the emulsifiers given above, in the preparation for carrying out the process according to the invention, there may be mentioned inter alia: addition products of an alkylene oxide with fatty alcohols or with alkyl phenols, preferably addition products of an ethylene oxide with fatty alcohols having 8 to 24 carbon atoms, or with alkylphenols having 10 to 18 carbon atoms, with these addition products preferably containing 3 to 20 ethylene oxide units. As an example of a specific wetting agent which can be particularly well suited for use in the preparation used according to the invention, there may be mentioned, inter alia, the ethylene oxide adduct of nonylphenol, which contains 9 ethylene oxide units in the molecule.

In the aqueous emulsion, which contains an emulsifier and optionally a wetting agent, an addition of 10 percent by weight of emulsifier and 10 percent by weight of wetting agent, relative to the content of acid amide of the formula (1) or of the reaction product, is as a rule sufficient. Thus, the diluted preparation contains 0.01 to 0.05 percent by weight of at least one emulsifier and optionally 0.01 to 0.05 percent by weight of at least one wetting agent, relative to the dry textile material to be treated.

The preparations for performing the process according to the invention in general have a pH value of 4 to 6, preferably 5 to 6, which can be adjusted if necessary by the addition of a weak acid. Both inorganic weak acids, such as boric acid, phosphoric acid and carbonic acid, and mainly weak organic acids preferably having at most 4 carbon atoms, such as oxalic acid, formic acid, acetic acid, propionic acid and butyric acid, are suitable, with acetic acid being preferred.

The emulsion is produced by melting at least one acid amide of the formula (1) or at least one reaction product from acrylic acid or methacrylic acid, or alkyl esters thereof, and the amine of the formula (2), and then adding in the course of 5 to 20 minutes, with rapid stirring, an aqueous solution which is at a temperature of at least 90° C. and which contains at least one commercial emulsifier and optionally at least one commercial wetting agent of the stated type, the pH value of this solution being adjusted with an acid of the given type, particularly acetic acid, to 4 to 6. This emulsion is then advantageously subjected to high-pressure emulsification, at for example 300 to 400 Kp, for 20 to 60 minutes. The high-pressure emulsion is then cooled to room temperature, in the process of which there is generally formed a fine dispersion. This concentrated composition contains, in a novel combination, 1 to 50, preferably 5 to 25, percent by weight of the acid amide of the formula (1) or of the reaction product from acrylic acid or methacrylic acid, or esters thereof, and the amine of the formula (2), 0.1 to 5, preferably 0.5 to 2.5, percent by weight of the emulsifier described in the foregoing, and 0 to 5, preferably 0.1 to 5, especially 0.5 to 2.5, percent by weight of the wetting agent described in the foregoing. The concentrated composition has a pH value of 4 to 6, preferably 4 to 5. The great advantage of of this concentrated composition is its good stability. Even after several months of storage, the composition remains homogeneous and ready for use.

To produce the diluted preparation, which is applied to the textile materials, the concentrated emulsion described in the foregoing, preferably the high-pressure emulsion which at room temperature is as a rule in the form of a fine stable dispersion, is placed into the mixing vessel just at the moment that the emulsion is to be used, and to it is then added the 5- to 10-fold amount of water at 60° to 90° C., and the whole is subsequently stirred. Not until afterwards is the dispersion further diluted with cold water, the pH value of which has been adjusted to 4 to 6 with an acid of the given type, for example acetic acid, the degree of dilution being such that there is obtained the given concentration of acid amide or of the reaction product of 0.1 to 0.5 percent by weight, relative to the textile material to be treated, which is advantageous for application.

As textile materials to which can be imparted a soft handle by the process according to the invention, there can be used materials from natural or synthetic fibres, and also mixtures thereof, preferably mixtures of natural fibres with synthetic fibres.

The textile material can be at any stage of processing, that is to say, it can be in the form of staple fibres, continuous filaments, or fleeces, particularly however in the form of flocks, yarns, fabrics or knitted goods, or articles of clothing which have already been further processed. The textile materials can have been dyed or can have been treated with an optical brightener.

The synthetic materials treated can be both semi-synthetic textile materials, for example those made from regenerated cellulose, that is to say, rayon fibres, artificial silk, viscose or cellulose acetate; and fully-synthetic textile materials, for example those made from polyacrylonitrile, acrylonitrile copolymers, polyamide or polyester.

In the case of the textile materials made from acrylonitrile copolymers or from modacrylic fibres, the proportion of acrylonitrile is advantageously at least 50 percent by weight and preferably at least 85 percent by weight of the copolymer. Copolymers particularly suitable are those for the production of which other vinyl compounds, for example vinyl chloride, vinylidene chloride, methacrylates, acrylic amide or styrenesulfonic acid, have been used as comonomers. Suitable polyamides for producing the fibres in the textile materials are for example: poly-2-caprolactam, polyhexylmethylenediamide-adipate or poly-ω-amino-undecanoic acid, while suitable polyesters are for example: poly-(ethylene glycol terephthalate) or poly-(1,4-cyclohexylenedimethylene terephthalate).

As examples of textile materials made from natural fibres there may be mentioned: sisal, line, hemp and ramie, but preferably wool and in particular cotton. Materials to which a soft handle can be imparted particularly readily by the process according to the invention are above all textile materials from cotton, wool, polyamide, polyacrylonitrile, and mixtures of wool and polyacrylonitrile, of wool and polyester and of cotton and polyester. Polyacrylonitrile yarns are particularly of interest.

According to the invention, the preparations are applied by customary processes to the textile materials. Thus, for example, the preparations can be sprayed or slop-padded onto the textile materials. Preferably, however, the textile materials are padded with the preparations or are treated therewith using the exhaust process. The application is effected at room temperature or at elevated temperatures of, for example, 30° to 100° C. for 5 to 120 minutes. The textile materials are subsequently dried at room temperature or preferably at elevated temperature, for instance at 50° to 150° C.

A particular advantage of the process according to the invention is the compatibility of the employed acid amides of the formula (1) or of the reaction products and the concomitantly used emulsifiers and optionally concomitantly used wetting agents with commercial dyes and optical brighteners. Furthermore, there occurs with many dyes, especially with basic dyes, in the dyeing of polyacrylonitrile fibres no retarding action of the acid amide of the formula (1), or of the reaction product, on the concomitantly used dye. In particular, the acid amide has no unfavourable effect on the colouring strength, shade and levelness of the dyeings obtained. This is manifested especially in dyeing with dye mixtures, for example in the so-called trichromic process. In a particular embodiment of the process according to the invention, it is possible to impart a soft handle to the textile materials and to simultaneously dye them, that is to say, in a single treatment stage. This single treatment stage saves the energy costs which would otherwise be necessary for imparting a soft handle in a separate stage. In order to impart a soft handle and to simultaneously dye the material, there is preferably used the aforementioned exhaust process, wherein the liquor to be applied contains, in addition to the acid amide of the formula (1) or the reaction product, an emulsifier and optionally a wetting agent, also a commercial dye suitable for the type of materials to be dyed, and optionally a commercial dyeing auxiliary. It is also possible according to the invention to impart a soft handle to brightened textile material, without the degree of whiteness of the materials being impaired as a result. The same applies also when a soft handle is imparted to the textile materials at the same time as they are being brightened.

A further advantage of the process according to the invention is that the soft-handle effects obtained are well fixed and hence as a rule are fast to fine washing. The textile materials to which has been imparted a soft handle and which are fast to fine washing can, after drying, be subsequently washed at a temperature of up to about 50° C. in a domestic washing machine of customary design, with use of a commercial fine detergent, without the excellent soft-handle effects being significantly impaired. In the case of application to hydrophilic textile materials, for example cotton sponge cloth, the soft handle is imparted to the materials without any noticeable effect on their hydrophilic properties.

Particularly advantageous also is the wide range of types of materials to which a soft handle can be successfully imparted by the process according to the invention, that is to say, the versatility of application of the process according to the invention.

In a further preferred embodiment of the process according to the invention, the acid amide of the formula (1) or the reaction product from acrylic acid or methacrylic acid, and alkyl esters thereof, with the amine of the formula (2) can be used as an agent imparting a soft handle in dry-cleaning or as a rinsing agent for rendering household linen soft. In dry-cleaning, the concentrated emulsion, preferably high-pressure emulsion, which at room temperature is usually in the form of a dispersion, is added direct, that is to say, without further dilution with water, to the organic solvent used for the cleaning operation, for example perchloroethylene. Alternatively, in the washing of textile materials in the home using the customary washing procedure, the rinsing agent for imparting a soft feel is added in the form of the aqueous preparation, obtained by dilution of the concentrated emulsion or dispersion in the manner described in the foregoing, to the last rinsing bath.

In the following production instructions and examples, 'parts' and 'percentages' are by weight.

PRODUCTION INSTRUCTIONS FOR EMULSIONS

A. 7.5 parts of an emulsifier consisting of a reaction product from 2 mols of diethanolamine and 1 mol of stearic acid, and also 8.75 parts of a wetting agent consisting of an addition product of 9 mols of ethylene oxide with 1 mol of nonylphenol, are dissolved in 608.75 parts of water; the solution is heated to 95° C., and the pH value is adjusted to 4 with acetic acid. As a soft-handle agent, 75 parts of the acid amide of the formula $$CH_2{=}CH{-}CO{-}NH{-}(CH_2)_{17}{-}CH_3 \quad (8)$$

are melted at 95° C. To this melt at 95° C. are added in the course of 10 minutes, with rapid stirring, the acid aqueous solution of the emulsifier and wetting agent. After being stirred at 95° C. for 5 minutes, the resulting pre-emulsion is subjected for 30 minutes to high-pressure emulsification at 350 Kp. The high-pressure emulsion is then cooled to 20° C. There is thus obtained a fine dispersion which is ready for use and which is storage-stable over several months. It contains 10.7% of the acid amide of the formula (4) as soft-handle agent.

B. The procedure is carried out as described in Instruction A except that the emulsifier added consists of 7.5 parts of a reaction product from 1 mol of diethylenetriamine, 1 mol of acrylonitrile and 2 mols of stearic acid, and the soft-handle agent added consists of 75 parts of the acid amide of the formula $$CH_2{=}CH{-}CO{-}NH{-}R_4 \quad (9)$$

wherein $R_4$ denotes 50 to 80% of $-(CH_2)_{17}-CH_3$
20 to 30% of $-(CH_2)_{15}-CH_3$
5 to 15% of $-(CH_2)_{13}-CH_3$.

C. The procedure followed is as given in Instruction A except that the emulsifier added consists of 7.5 parts of a reaction product from 1 mol of diethylenetriamine and 2 mols of stearic acid, which reaction product is quaternised with dimethyl sulfate, and the soft-handle agent added consists of 75 parts of the acid amide of the formula given in Instruction B.

D. The procedure followed is as given in Instruction A except that the soft-handle agent added comprises 75 parts of the acid amide of the formula $$CH_2{=}CH{-}CO{-}NH{-}R_5 \quad (10)$$

wherein $R_5$ denotes 40 to 60% of $-(CH_2)_{15}-CH_3$
20 to 40% of $-(CH_2)_8-CH{=}CH-(CH_2)_7-CH_3$
10 to 20% of $-(CH_2)_{17}-CH_3$
0 to 5% of $-(CH_2)_{13}-CH_3$
0 to 5% of $-(CH_2)_8-CH{=}CH-CH_2-CH{=}CH(CH_2)_4-CH_3$.

E. The procedure followed is as given in Instruction A except that the soft-handle agent added consists of 75 parts of the acid amide of the formula $$CH_2{=}CH{-}CO{-}NH{-}R_6 \quad (11)$$

wherein $R_6$ denotes 60 to 70% of $-(CH_2)_{21}-CH_3$
30 to 40% of $-(CH_2)_{19}-CH_3$.

F. The procedure followed is as given in Instruction A except that the soft-handle agent added consists of 75 parts of the acid amide of the formula $$CH_2{=}\overset{\overset{\displaystyle CH_3}{|}}{C}{-}CO{-}NH{-}R_4 \quad (12)$$

wherein $R_4$ has the meaning given in Instruction B.

G. The procedure followed is as given in Instruction A except that the soft-handle agent added consists of 75 parts of the acid amide of the formula $$CH_2{=}CH{-}CO{-}NH{-}R_7 \quad (13)$$

wherein $R_7$ denotes 40 to 60% of $-(CH_2)_8-CH{=}CH-(CH_2)_7-CH_3$
20 to 40% of $-(CH_2)_{17}-CH_3$
10 to 20% of $-(CH_2)_{15}-CH_3$
0 to 5% of $-(CH_2)_{13}-CH_3$
0 to 5% of $-(CH_2)_8-CH{=}CH-CH_2-CH{=}CH-(CH_2)_4-CH_3$.

H. The procedure followed is as given in Instruction A except that the soft-handle agent added consists of 75 parts of the acid amide of the formula given in Instruction B.

I. The procedure followed is as given in Instruction A except that the soft-handle agent added consists of 75 parts of the acid amide of the formula $$CH_2{=}CH{-}CO{-}NH{-}R_8 \quad (14)$$

wherein $R_8$ denotes 30 to 50% of $-(CH_2)_8-CH{=}CH-(CH_2)_7-CH_3$
20 to 30% of $-(CH_2)_{17}-CH_3$
10 to 20% of $-(CH_2)_{15}-CH_3$
5 to 15% of $-(CH_2)_{13}-CH_3$
5 to 15% of $-(CH_2)_8-CH{=}CH-CH_2-CH{=}CH-(CH_2)_4-CH_3$.

J. The procedure followed is as given in Instruction A except that the soft-handle agent added consists of 75 parts of the acid amide of the formula $$CH_2{=}\underset{\underset{CH_3}{|}}{C}{-}CO{-}NH{-}R_8 \quad (15)$$

wherein $R_8$ has the meaning given in Instruction I.

K. The procedure followed is as given in Instruction A except that, for comparative purposes, no acid amide as soft-handle agent is added.

EXAMPLE 1

A polyacrylonitrile yarn is treated for 20 minutes at 40° C. in the exhaust process, with a ratio of goods to liquor of 1:30, using an aqueous preparation of which the pH value has been adjusted to 5.5 with acetic acid and which contains, relative to the weight of the yarn, 2% of the dispersion according to Instruction A. To the dispersion is added before its application the 5-fold amount of water at 80° C.; the dispersion is then stirred and subsequently diluted with cold water, the pH value of which has been adjusted to 5.5 with acetic acid. After the exhaust operation, the yarn is dewatered without rinsing and is then dried at 60° C.

After drying and after conditioning at 20° C. with 40% relative humidity for 24 hours, the soft handle of the yarn is assessed, while 0 (no soft handle effect) representing the poorest rating and 4 (very good soft handle effect) the highest rating. In order to assess the fastness to fine-washing possessed by the soft-handle finish of the yarn, this is washed in a domestic washing machine for 30 minutes at 40° C. with a liquor containing per liter 2 g of a commercial fine detergent.

The yarn treated in this manner receives both before and after machine washing the rating 4 in the soft-handle test, whereas the untreated yarn receives the rating 0.

EXAMPLE 2

A polyacrylonitrile yarn is dyed, in a hank dyeing machine, in the exhaust process using a goods to liquor ratio of 1:35 with the dye liquors A and B of the following compositions, respectively, with a soft-handle finish being simultaneously imparted to the yarn.

Liquor A 0.28% of the yellow dye of the formula

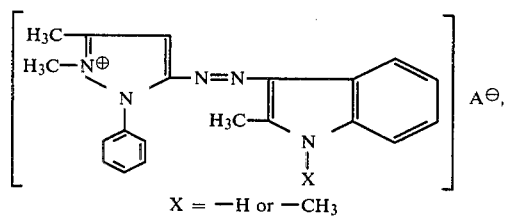

(16)

0.14% of the red dye of the formula

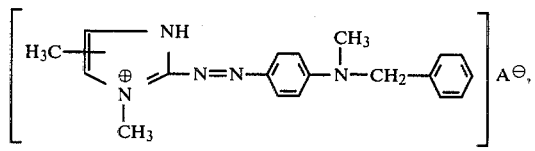

(17)

0.35% of the blue dye of the formula

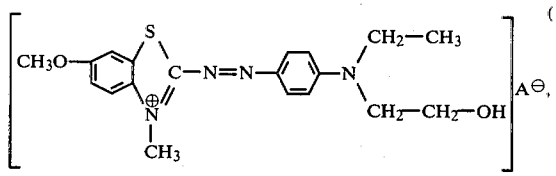

(18)

2% of 40% acetic acid (pH of the dye liquor: 4.5),
1% of an alkylammonium salt as commercial levelling agent, and
2% of the dispersion according to Instruction A.

Liquor B 0.15% of the yellow dye of the formula

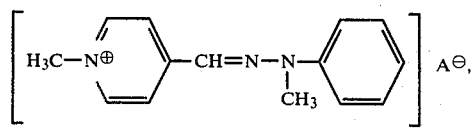

(19)

0.20% of the red dye of the formula

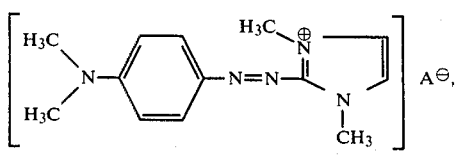

(20)

0.30% of the blue dye of the formula

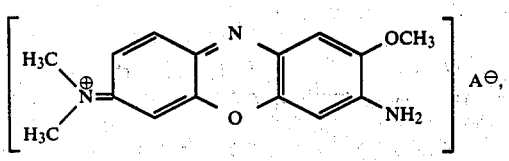

(21)

2% of 40% acetic acid (pH of the dye liquor: 4.5),
10% of $Na_2SO_4.10H_2O$, and
2% of the dispersion according to Instruction A.

The dilution of the dispersion according to Instruction A is carried out as described in Example 1.

In the formulae (14) to (16), $A^{\ominus}$ denotes an anion, for example
$CH_3SO_4^{\ominus}$,
$\frac{1}{2}SO_4^{\ominus\ominus}$,
$Cl^{\ominus}$ or $ZnCl_3^{\ominus}$.

All percentages of the constituents of the liquors A and B are relative to the weight of yarn to be treated.

In dyeing by the so-called trichromic process, the yarn is immersed in the liquors A and B, respectively, at 60° C.; the yarn is then heated in the respective dye liquor, at a heating-up rate of 1° C. per minute, to 98° C., held for 60 minutes at this temperature, and after this period of time cooled again to 60° C. Without being rinsed, the dyed yarn is subsequently dewatered, and dried at 60° to 70° C. The yarns treated with the liquors A and B, respectively, receive the soft-handle rating 4. Furthermore, the presence of the dispersion according to Instruction A in the dye baths A and B has no retarding action on the employed dyes. There are obtained level grey dyeings having good depth of colour in the desired shade.

The yarns treated with the liquors A and B, respectively, according to Instruction A but without dispersion, as well as untreated yarn, are given the soft-handle rating 0.

EXAMPLE 3

The procedure is performed in the manner described in Example 1 except that there is used an aqueous preparation containing 2% of the dispersion according to the following Table I instead of 2% of the dispersion according to Instruction A. The results of the soft-handle assessment, before and after washing with the fine detergent in the domestic washing machine, are likewise summarised in the following Table I.

TABLE I

| Emulsion used in the preparation | Soft-handle test (ratings) before washing | after washing |
|---|---|---|
| dispersion according to Instruction B | 4 | 3.5 |
| dispersion according to Instruction C | 4 | 3.5 |
| dispersion according to Instruction D | 4 | 3.5 |
| dispersion according to Instruction E | 3.5 | 3.5 |
| dispersion according to Instruction F | 3.5 | 3.5 |
| emulsion according to Instruction K (contains no soft-handle agent) | 1.0 | 0.5 |
| untreated yarn | 0 | 0 |

Similar results are obtained with the dispersions according to Instructions G, H, I and J.

EXAMPLE 4

A soft-handle finish is imparted, in separate baths in the exhaust process, to the following substrates: a cotton sponge cloth (CO), a woollen knitting yarn (WO), a crimp yarn made from polyamide (PA), a blended yarn made from wool and polyacrylonitrile (WO/PAC 50:50), a blended yarn made from wool and polyester (WO/PES 50:50), and a yarn made from a mixture of cotton and polyester (CO/PES 50:50). The treatment is carried out during 20 minutes at 40° C., with a ratio of goods to liquor of 1:30, using an aqueous preparation of which the pH value is adjusted to 5.5 with acetic acid, and which contains, relative to the weight of the material, 2% or 3% of the dispersion according to Instruction A, which has been diluted as described in Example 1. The cotton sponge cloth and the yarns and blended yarns mentioned in the foregoing are subsequently dewatered without being rinsed and are then dried at 60° C. The results of the soft-handle test after drying and conditioning are summarised in the following Table II. The untreated textile materials receive a handle rating of 0.

TABLE II

| Treated material | Amount of dispersion according to Instruction A | Soft handle rating |
|---|---|---|
| CO | 3% | 4 |
| WO | 2% | 3.5 |
| PA | 2% | 4 |
| WO/PAC 50:50 | 3% | 3.5 |
| WO/PES 50:50 | 3% | 3 |
| CO/PES 50:50 | 3% | 3.5 |

EXAMPLE 5

10 g of wool tricot is treated in a 0.5 liter vessel, in the presence of 150 ml of perchloroethylene, in a shaking machine for 10 minutes. After removal of the perchloroethylene, this cleaning operation is repeated but with addition of 1 g of the undiluted dispersion according to Instruction A in the employed perchloroethylene. After removal of the perchloroethylene, the wool tricot is centrifuged and then dried at 80° C. It receives the rating 2.5 in the soft-handle test, whereas a wool tricot treated in the same manner with perchloroethylene but in the absence of the dispersion according to Instruction A receives the rating 0.

EXAMPLE 6

The procedure is carried out as described in Example 5 except that 10 g of polyacrylonitrile tricot is used in place of the wool tricot. The tricot treated according to the invention receives the rating 3 in the soft-handle test, whereas polyacrylonitrile tricot treated in the absence of the dispersion according to Instruction A receives the rating 0.

EXAMPLE 7

The procedure is carried out as described in Example 5 except that 10 g of polyester knitted fabric is used in place of the wool tricot. The fabric treated according to the invention receives the rating 2 in the soft-handle test, whereas polyester fabric treated in the absence of the dispersion according to Instruction A receives the rating 0.

EXAMPLE 8

2.5 kg of a polyacrylonitrile tricot is washed in a domestic washing machine (capacity: 5 kg of washing and 12 liters of water) is washed with an aqueous liquor at 40° C. containing 30 g of a commercial fine detergent. The water used has a hardness of 15° (German degree of hardness). After the fine detergent has been washed out, the tricot is treated with a final rinsing bath at room temperature containing 50 g of the dispersion according to Instruction A, which dispersion has previously been diluted as described in Example 1. After being rinsed, the tricot is centrifuged and then dried at 80° C. It is given the rating 4 in the soft-handle test, whereas a polyacrylonitrile tricot washed in the same manner but rinsed in the absence of the dispersion according to Instruction A is given the rating 0.

EXAMPLE 9

The procedure is carried out as described in Example 8 except that 2.5 kg of a polyester knitted fabric is used instead of the polyacrylonitrile tricot. The tricot washed and rinsed according to the invention receives the rating 2.5 in the soft-handle test, whereas polyester fabric which has been similarly washed but rinsed in the absence of the dispersion according to Instruction A receives the rating 0.

EXAMPLE 10

The procedure is carried out as described in Example 8 except that 2.5 kg of a polyamide knitted fabric is used in place of the polyacrylonitrile tricot. The knitted fabric washed and rinsed according to the invention receives the rating 3 in the soft-handle test, whereas polyamide knitted fabric which has been similarly washed but rinsed in the absence of the dispersion according to Instruction A receives the rating 0.

EXAMPLE 11

The procedure is carried out as described in Example 8 except that 2.5 kg of a cotton sponge cloth is used in place of the polyacrylonitrile tricot. The sponge cloth washed and rinsed according to the invention receives the rating 3 in the soft-handle test, whereas cotton sponge cloth which has been washed but then rinsed in the absence of the dispersion according to Instruction A receives the rating 0.

What is claimed is:

1. A process for imparting to a textile material a soft handle, which process comprises immersing the material at 20° to 100° C. for 5 to 120 minutes in an aqueous preparation containing an acid amide of the formula $$CH_2{=}C(X){-}CO{-}NH{-}R_1$$

or a reaction product from acrylic or methacrylic acid, or an alkyl ester thereof, and an amine of the formula $$R_1{-}NH_2$$

wherein $R_1$ is alkyl or alkenyl of 14 to 22 carbon atoms and X is hydrogen or methyl, and subsequently drying the material at 50° to 150° C.

2. A process according to claim 1 in which there is used the acid amide of the formula $$CH_2{=}C(X){-}CO{-}NH{-}(CH_2)_{17}{-}CH_3$$

in which X is hydrogen or methyl.

3. A process according to claim 1 in which the preparation contains 0.1 to 0.5 percent by weight, relative to the dry textile material, of the acid amide or of the reaction product.

4. A process according to claim 1 in which the preparation is in the form of an aqueous emulsion or dispersion.

5. A process according to claim 1 in which the preparation contains, in addition to the acid amide or to the reaction product, 0.01 to 0.05 percent by weight, relative to the dry textile material, of an emulsifier.

6. A process according to claim 1 in which the preparation contains, in addition to the acid amide or to the reaction product and in addition to the emulsifier, 0 to 0.05 percent by weight, relative to the dry textile material, of a wetting agent.

7. A process according to claim 1 in which the preparation has a pH value of 4 to 6.

8. A process according to claim 1 in which the textile material consists of natural or synthetic fibers, or of mixtures of natural and synthetic fibers.

9. A process according to claim 1 in which the textile material contains wool, cotton, polyacrylonitrile, polyester or polyamide.

10. A concentrated composition for performing the process according to claim 1, which composition is in the form of an aqueous emulsion or dispersion which contains 10 to 50 percent by weight of the melted acid amide or of the reaction product, 0.1 to 5 percent by weight of an emulsifier, and 0 to 5 percent by weight of a wetting agent.

11. A composition for performing the process according to claim 1, which has a pH value of 4 to 6 which is adjusted to the required value with a weak acid.

12. A composition for performing the process according to claim 1, which is obtained from a high-pressure emulsion and which at room temperature is in the form of a dispersion.

* * * * *